US005593259A

United States Patent [19]

Kuo

[11] Patent Number: 5,593,259

[45] Date of Patent: Jan. 14, 1997

[54] MOTOR SCOOTER PACKAGING CASE

[75] Inventor: Hui-Kuei Kuo, Kaohsiung, Taiwan

[73] Assignee: Shin Yowu Industry Co., Ltd., Kaohsiung, Taiwan

[21] Appl. No.: 489,228

[22] Filed: Jun. 12, 1995

[51] Int. Cl.[6] ..... B60P 7/06

[52] U.S. Cl. ..... 410/3; 410/7; 410/30; 410/120; 206/335

[58] Field of Search ..... 410/2, 3, 7, 30, 410/43, 31, 77, 80, 120; 220/1.5, 4.01; 206/335; 280/79.3, 33, 998

[56] References Cited

U.S. PATENT DOCUMENTS

| | | | |
|---|---|---|---|
| 1,638,612 | 8/1927 | Baus | 410/120 |
| 3,955,847 | 5/1976 | Schiowitz | 410/30 X |
| 4,450,969 | 5/1984 | Marsh, Jr. | 280/79.3 X |
| 4,804,087 | 2/1989 | Smith | 206/335 |
| 4,852,779 | 8/1989 | Berg | 410/3 X |
| 4,991,715 | 2/1991 | Williams | 206/335 |
| 5,133,453 | 7/1992 | Fritze | 206/335 |
| 5,203,655 | 4/1993 | Persau | 410/3 |

FOREIGN PATENT DOCUMENTS

| | | | |
|---|---|---|---|
| 1151531 | 1/1958 | France | 410/3 |
| 612468 | 10/1960 | Italy | 206/335 |
| 2-85034 | 3/1990 | Japan | 410/3 |
| 5-254587 | 10/1993 | Japan | 206/335 |
| 825380 | 4/1981 | U.S.S.R. | 206/335 |
| 954278 | 8/1982 | U.S.S.R. | 410/3 |

*Primary Examiner*—Frank E. Werner
*Assistant Examiner*—Stephen Gordon
*Attorney, Agent, or Firm*—Alfred Lei

[57] ABSTRACT

A motor scooter packaging case including a rectangular base frame having four side portions each having a first longitudinal recess open at a top, a rectangular upper frame having four side portions each having a second longitudinal recess open at a bottom, a rectangular front side frame having a lower end fitted within the first longitudinal recess of the rectangular base frame and the second longitudinal recess of the rectangular upper frame, a rectangular rear side frame having a lower end fitted within the first longitudinal recess of the rectangular base frame and the second longitudinal recess of the rectangular upper frame, a rectangular left side frame having a lower end fitted within the first longitudinal recess of the rectangular base frame and the second longitudinal recess of the rectangular upper frame, a rectangular right side frame having a lower end fitted within the first longitudinal recess of the rectangular base frame and the second longitudinal recess of the rectangular upper frame, and two reinforcing bars secured on the rectangular base frame, two U-shaped members each arranged on one of the two reinforcing bars, a cross bar mounted on the rectangular base frame and located across the two reinforcing bars, and a fixing rod provided at both ends with a hook adapted engage with the cross bar, whereby the motor packaging case can be used repeatedly.

8 Claims, 8 Drawing Sheets

MOTOR SCOOTER PACKAGING CASE

BACKGROUND OF THE INVENTION

1. Field of the Invention

This invention is concerned with a case and in particular to one for packaging motor scooters.

2. Description of the Prior Art

Heretofore, the conventional way to pack a motor scooter is achieved by first utilizing wooden bars to form a framework for keeping the scooter stabilized. However, such a wooden framework cannot be used repeatedly thereby increasing the packaging cost. Furthermore, the structure of the wooden framework is not reliable and needs binding ropes for reinforcement, resulting in inconvenience in use.

Therefore, it is an object of the present invention to provide a motor scooter packaging case which can obviate and mitigate the above-mentioned drawbacks.

SUMMARY OF THE INVENTION

This invention relates to an improved motor scooter packaging case.

It is the primary object of the present invention to provide a motor scooter packaging case which can be used repeatedly.

It is another object of the present invention to provide a motor scooter packaging case which is easy to assemble.

It is still another object of the present invention to provide a motor scooter packaging case which is sturdy in construction.

It is still another object of the present invention to provide a motor scooter packaging case which is convenient and reliable in use.

It is a further object of the present invention to provide a motor scooter packaging case which is easy and cheap to manufacture.

Other objects of the invention will in part be obvious and in part hereinafter pointed out.

The invention accordingly consists of features of constructions and method, combination of elements, arrangement of parts and steps of the method which will be exemplified in the constructions and method hereinafter disclosed, the scope of the application of which will be indicated in the claims following.

DESCRIPTION OF THE PREFERRED EMBODIMENT

Figure 1:
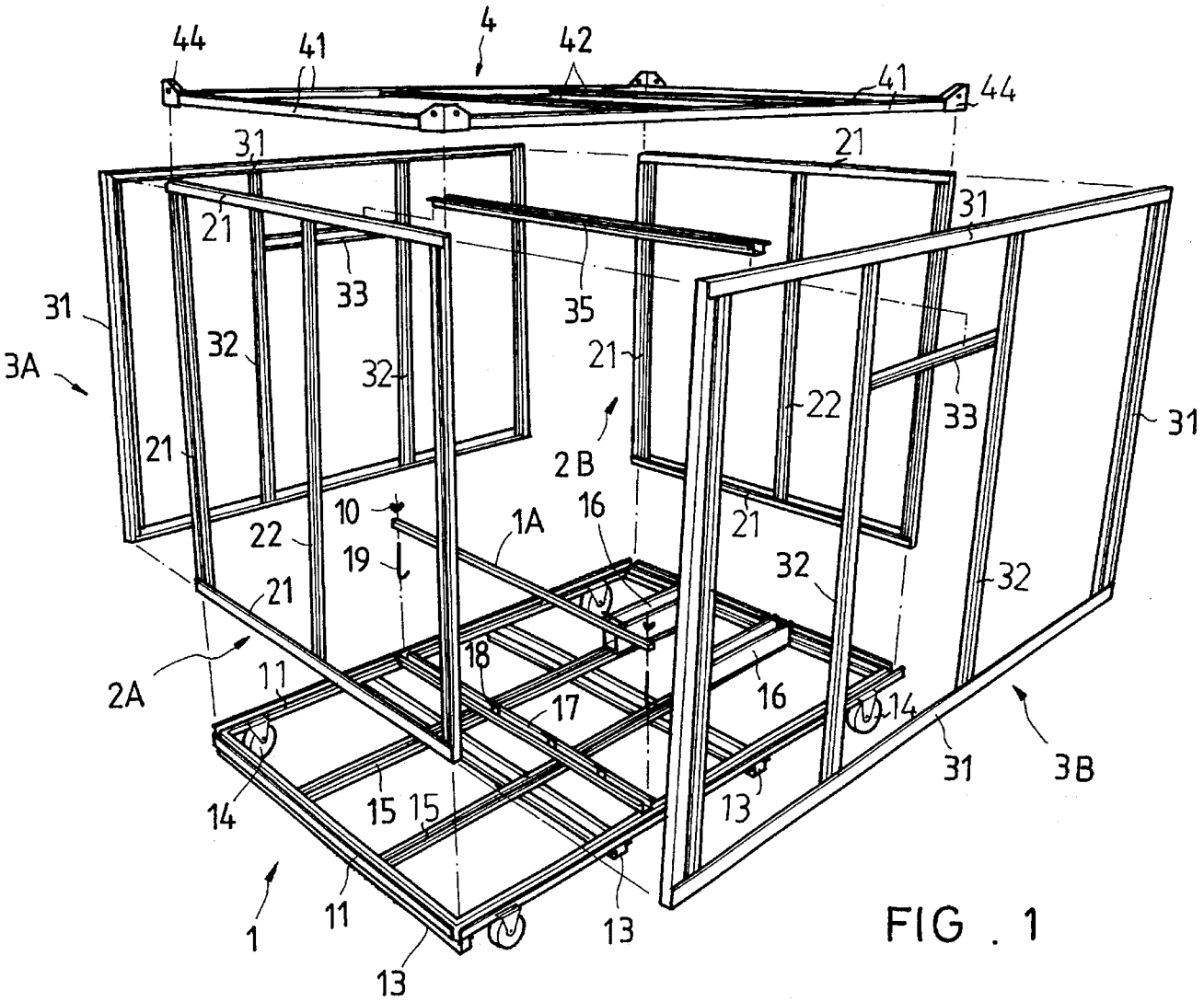
FIG. 1 is an exploded view of a motor scooter packaging case according to the present invention.

For the purpose of promoting an understanding of the principles of the invention, reference will now be made to the embodiment illustrated in the drawings. Specific language will be used to describe same. It will, nevertheless, be understood that no limitation of the scope of the invention is thereby intended, such alternations and further modifications in the illustrated device, and such further applications of the principles of the invention as illustrated herein being contemplated as would normally occur to one skilled in the art to which the invention relates.

Figure 2:
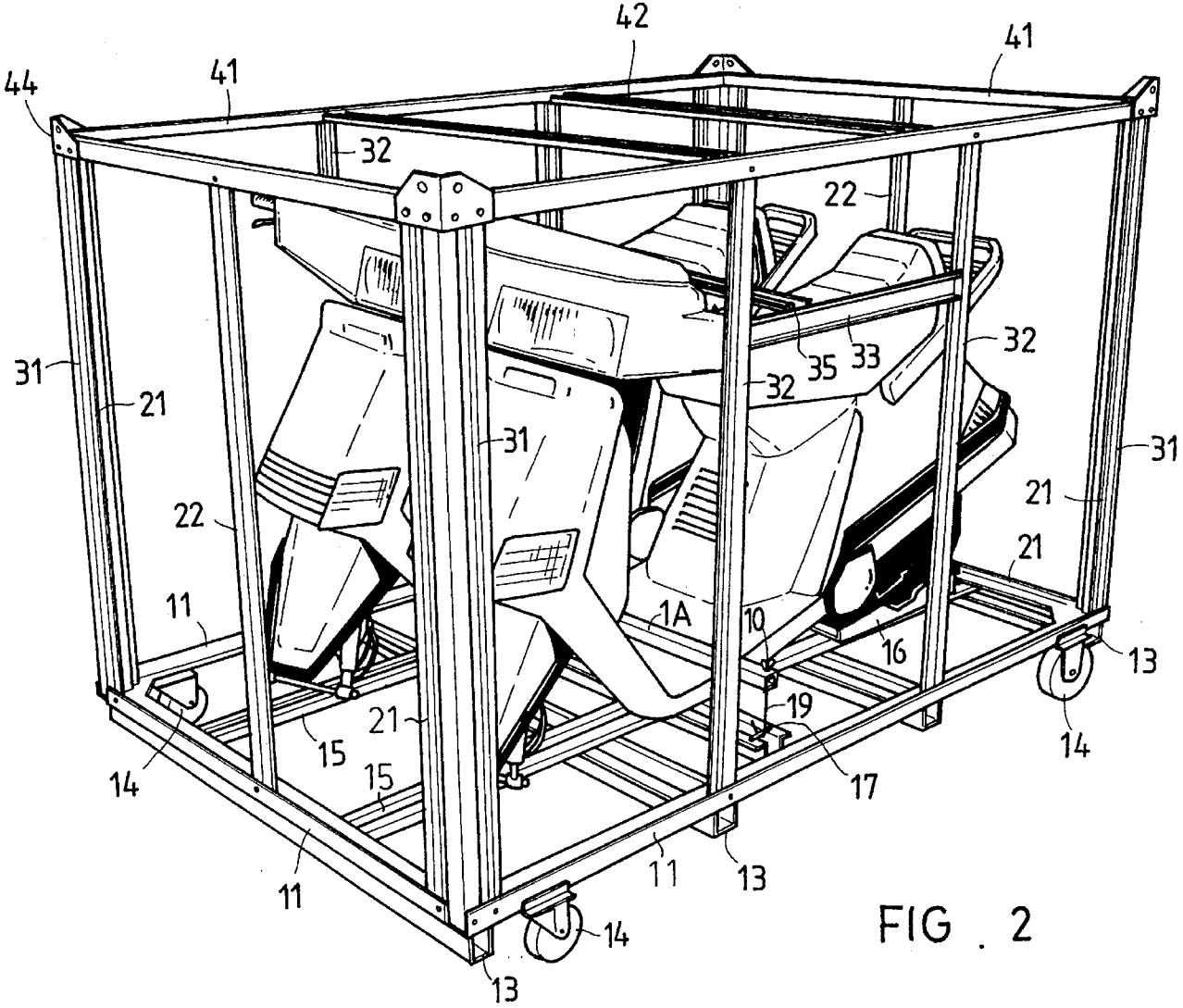
FIG. 2 is a perspective view of the motor scooter packaging case with a scooter mounted therein.

With reference to the drawings and in particular to FIGS. 1 and 2 thereof, the motor scooter packaging case according to the present invention mainly comprises a base frame 1, a front side frame 2A, a rear side frame 2B, a left side frame 3A, a right side frame 3B, and an upper frame 4.

Figure 3:
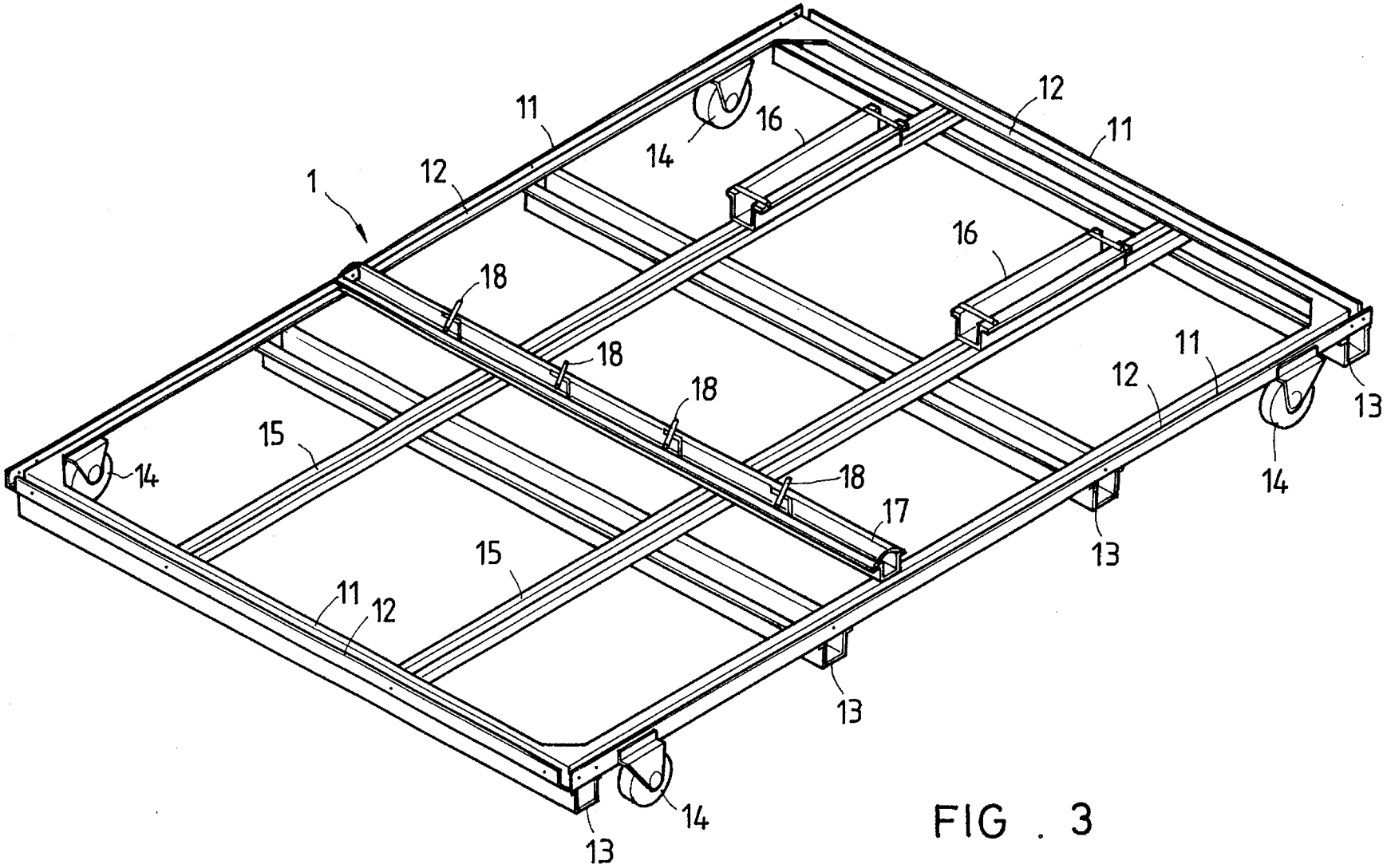
FIG. 3 is a perspective view of the base frame.
Figure 4:
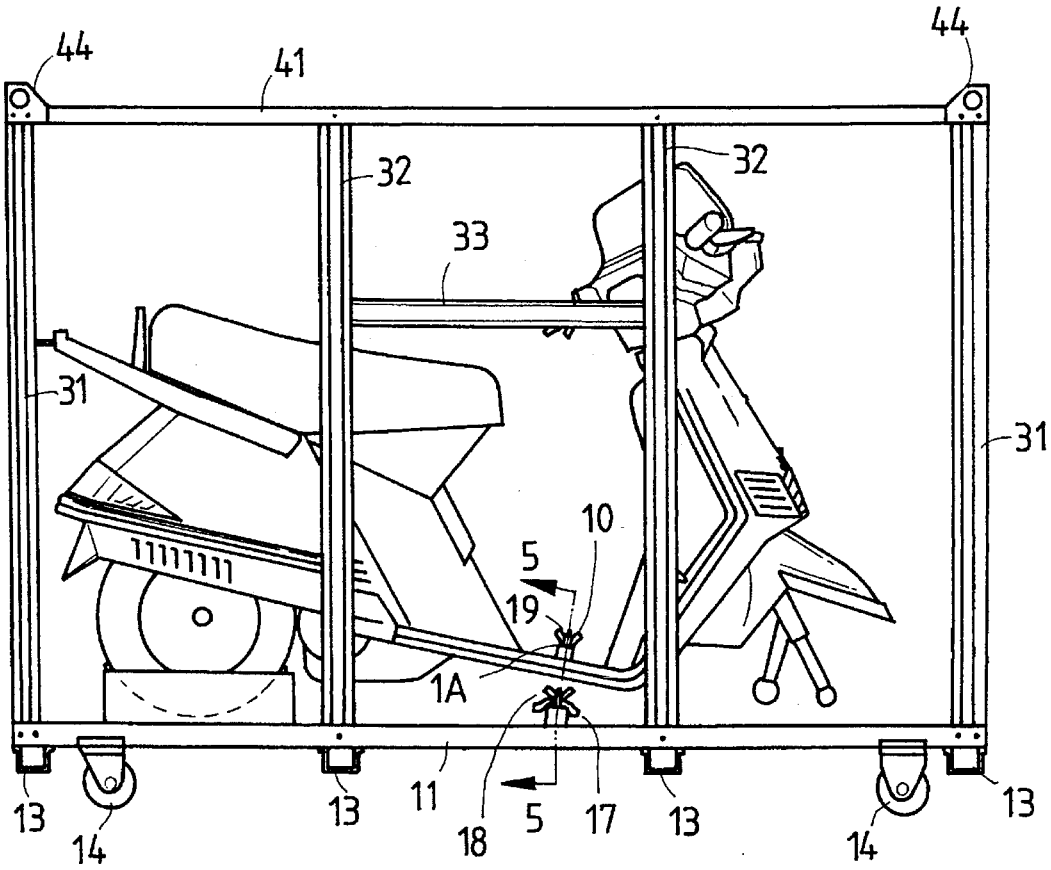
FIG. 4 is a side view of the motor scooter packaging case.

As shown in FIG. 3, the base frame 1 is a rectangular member including four side portions 11 and a rectangular recess 12 for receiving the lower portions of the front side frame 2A, the rear side frame 2B, the left side frame 3A, and the right side frame 3B. Under each of the base frame 1 there are mounted two transverse rods 13. Four castors 14 are mounted under the base frame 1. Two longitudinal rods 15 are installed on the base frame 1. On each of the longitudinal rods 15 is arranged a U-shaped member 16 for receiving a rear wheel of a scooter (see FIG. 4). A cross rod 17 is fixedly mounted on the base frame 1 and provided with a plurality of X-shaped members 18. The X-shaped members 18 are adapted to support the reinforcing bar 52 located at the bottom of the base board of the scooter 5. A fixing rod 1A is adapted to mount on the cross rod 17 so as to keep the base board of the scooter 5 therebetween. Both ends of the fixing rod 1A are provided with a hook 19. The upper end of the hook 19 extends upwardly through an end of the fixing rod 1A to engage with a nut 10.

Figure 7:
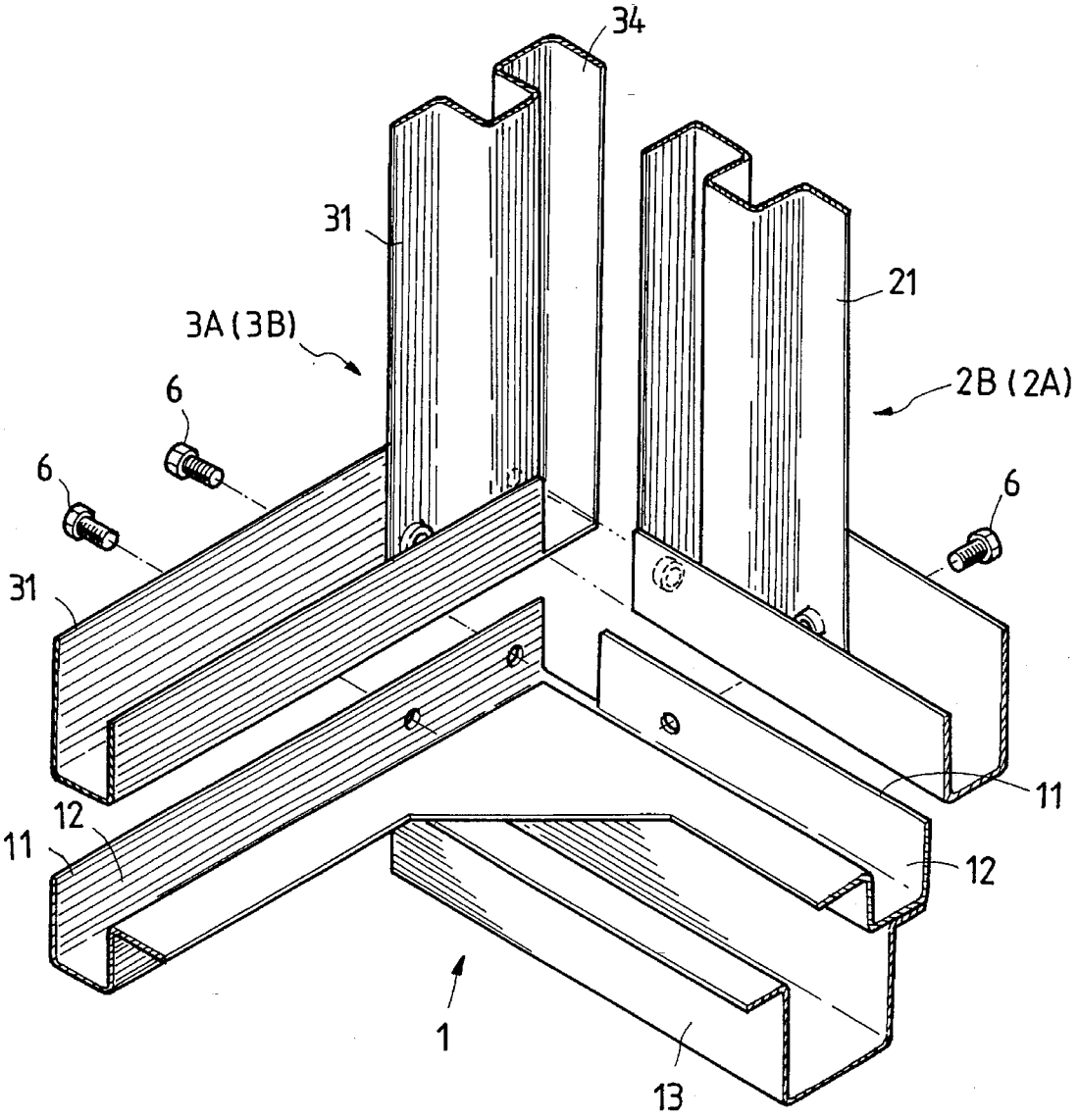
FIG. 7 illustrates the connection between the base frame, the front side frame, the rear side frame, the left side frame, and the right side frame.

Referring to FIGS. 1 and 2, the front side frame 2A and the rear side frame 2B are a rectangular member composed of four side rods 21. A reinforcing rod 22 is vertically mounted between the upper and lower side rods 21. The lower side rod 21 is adapted to fit within the recess 12 of the base frame 1 and fixedly connected thereto by screws 6 (see FIG. 7) thereby joining the front side frame 2A and the rear side frame 2B to the base frame 1.

Figure 5:
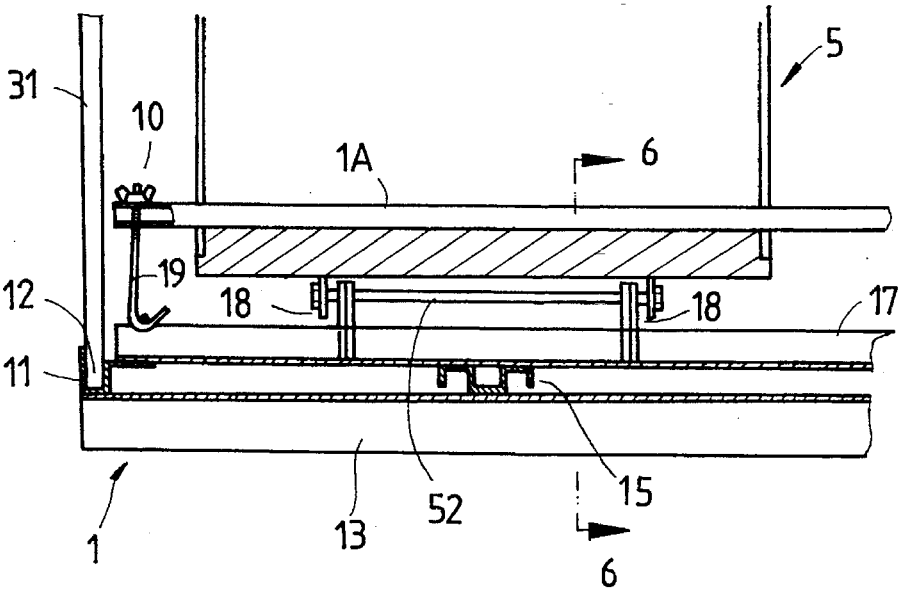
FIG. 5 is a sectional view taken along line 5—5 of FIG. 4.
Figure 6:
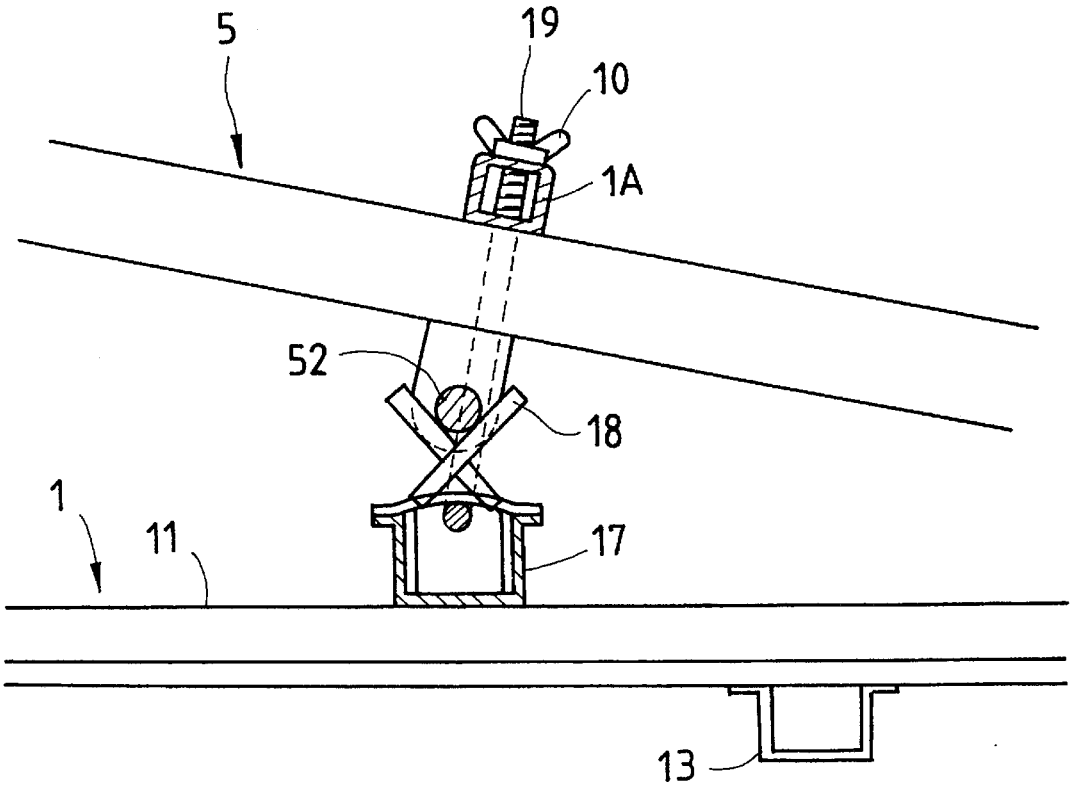
FIG. 6 is a sectional view taken along line 6—6 of FIG. 5.
Figure 8:
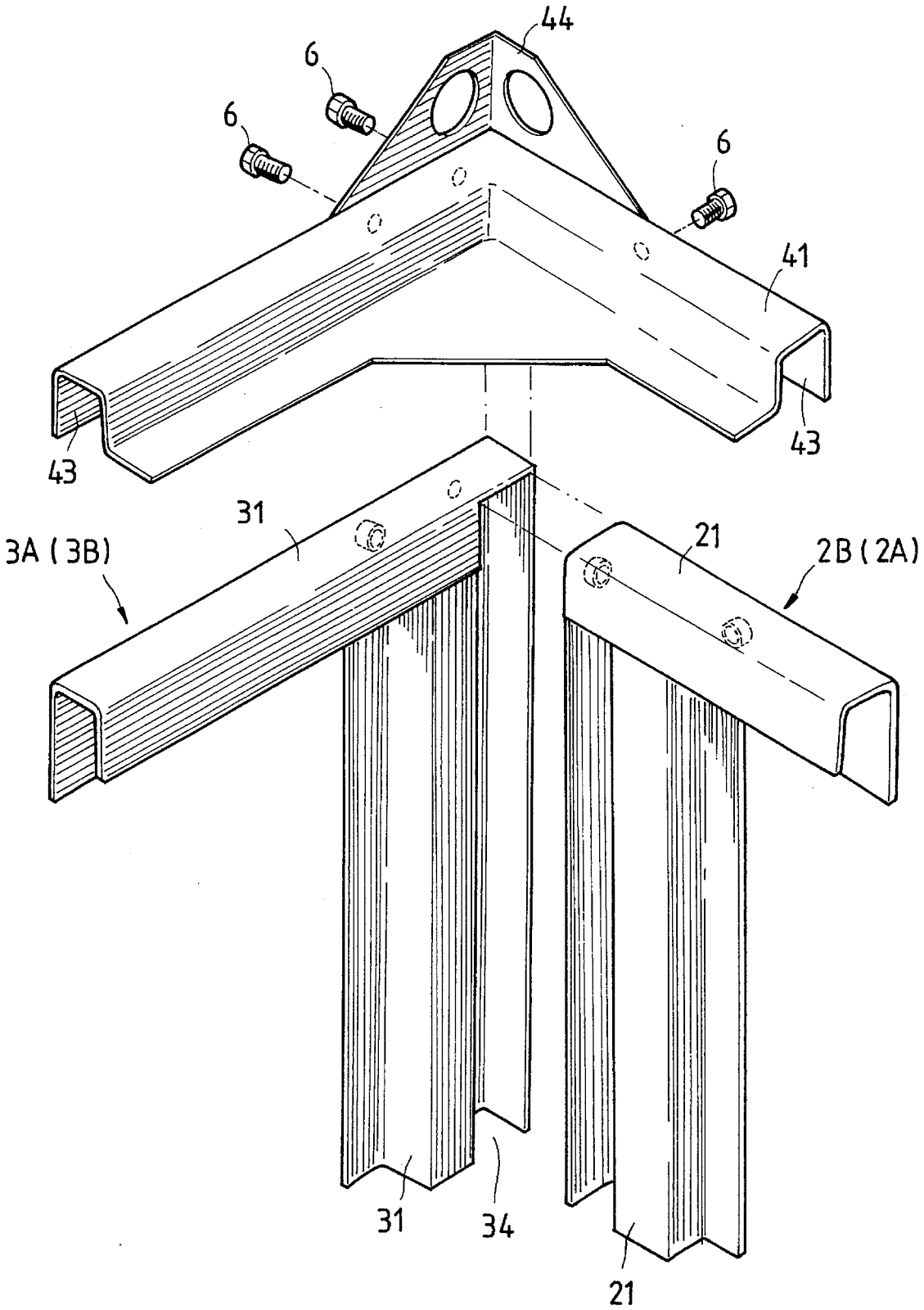
FIG. 8 illustrates the connection between the upper frame, the front side frame, the rear side frame, the left side frame, and the right side frame.
Figure 9:
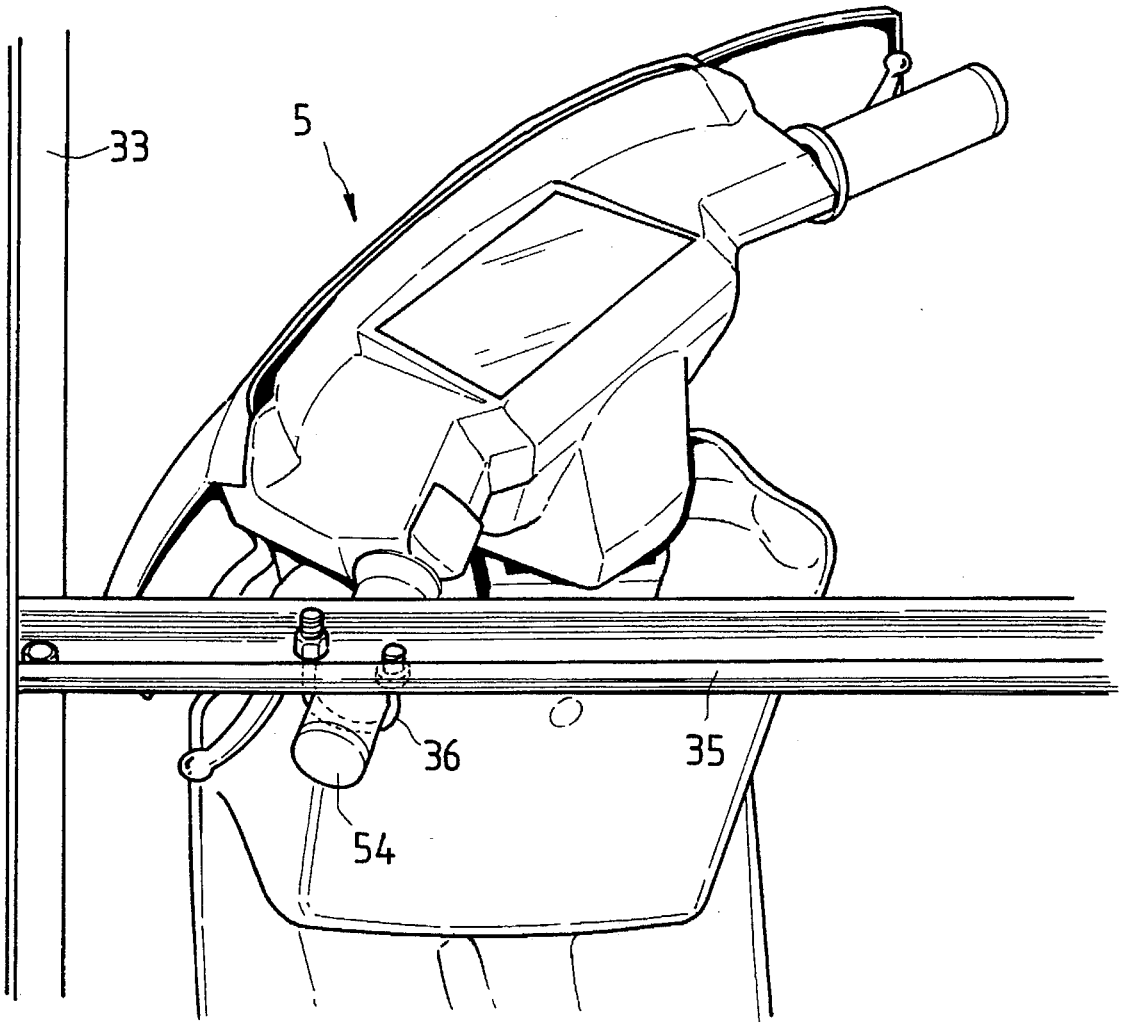
FIG. 9 illustrates how the handle is secured at a fixed position.

Looking now at FIGS. 1 and 2, the left side frame 3A and right side frame 3B are a rectangular member composed of four side bars 31. Two reinforcing bars 32 are vertically mounted between the upper and lower side rods 21. A reinforcing bar 33 is horizontally mounted between the two reinforcing bars 32. The lower bar 31 is adapted to fit within the recess 12 of the base frame 1 and fixedly connected thereto by screws 6 (see FIGS. 5 and 7) thereby joining the left side frame 3A and the right side frame 3B to the base frame 1. The vertical bar 31 is formed with a vertical recess 34 adapted to receive the vertical side rod 21 of the front side frame 2A or the rear side frame 2B and is fixedly connected thereto by screws 6 (see FIG. 8) thereby joining the front side frame 2A and the rear side frame 2B to the left side frame 3A and the right side frame 3B. A positioning bar 35 is mounted across the two reinforced bars 33 for keeping the handle 54 of of the scooter 5 in a fixed position. A U-shaped fixing member 36 is mounted on the lower side of the positioning bar 35 for enclosing the handle 54 (see FIG. 9).

As illustrated in FIGS. 1 and 2, the upper frame 4 is a rectangular frame including four side portions 41 and a rectangular recess 43 for receiving the upper side bars 21 of the front side frame 2A and rear side frame 2B and upper side bars 31 of the left side frame 3A and the right side frame 3B. The upper frame 4 is fixedly connected with the front side frame 2A, the rear side frame 2B, the left side frame 3A, and the right side frame 3B by screws 6 (see FIG. 8). Two reinforced bars 42 are mounted between two opposite side bars 41. A lug 44 is mounted at each corner of the upper frame 4 thus enabling the scooter packaging case to be hanged up.

The invention is naturally not limited in any sense to the particular features specified in the forgoing or to the details of the particular embodiment which has been chosen in order to illustrate the invention. Consideration can be given to all kinds of variants of the particular embodiment which has been described by way of example and of its constituent elements without thereby departing from the scope of the invention. This invention accordingly includes all the means constituting technical equivalents of the means described as well as their combinations.

I claim:

1. A motor scooter packaging case comprising:

a rectangular base frame having four side portions each having a first longitudinal recess open at a top;

a rectangular upper frame having four side portions each having a second longitudinal recess open at a bottom;

a rectangular front side frame having a lower end fitted within one said first longitudinal recess of said rectangular base frame and one said second longitudinal recess of said rectangular upper frame;

a rectangular rear side frame having a lower end fitted within a second one of said first longitudinal recesses of said rectangular base frame and a second one of said second longitudinal recesses of said rectangular upper frame;

a rectangular left side frame having a lower end fitted with a third one of said first longitudinal recesses of said rectangular base frame and a third one of said second longitudinal recesses of said rectangular upper frame;

a rectangnular right side frame having a lower end fitted within a fourth one of said first longitudinal recesses of said rectangular base frame and a fourth one of said second longitudinal recesses of said rectangular upper frame; and two reinforcing bars secured on said rectangular base frame;

two U-shaped members each arranged on one of said two reinforcing bars;

a cross bar mounted on said rectangular base frame and located across said two reinforcing bars; and a fixing rod provided at both ends with a hook adapted engaged with said cross bar.

2. The motor scooter packaging case as claimed in claim 1, further comprising four castors mounted on a bottom side of said rectangular base frame.

3. The motor scooter packaging case as claimed in claims 1 or 2, further comprising four lugs mounted on a top side of said rectangular upper frame.

4. The motor scooter packaging case as claimed in claims 1 or 2, wherein said cross bar is provided with a plurality of X-shaped members.

5. The motor scooter packaging case as claimed in claim 1, further comprising a positioning bar mounted between said left side rectangular frame and said right said rectangular frame.

6. The motor scooter packaging case as claimed in claim 5, wherein said positioning bar is provided with a U-shaped fixing member adapted to enclose a handle of a motor scooter.

7. The motor scooter packaging case as claimed in claim 1, wherein said rectangular base frame and said rectagnular upper frame are provided with a plurality of reinforcing rods.

8. The motor scooter packaging case as claimed in claim 1, wherein said left side frame and said right side frame are provided with a plurality of reinforcing rods.

* * * * *